US011466355B1

(12) United States Patent
Arumugam et al.

(10) Patent No.: US 11,466,355 B1
(45) Date of Patent: Oct. 11, 2022

(54) SUBMERGED UNDERWATER ELECTROLESS, ELECTROCHEMICAL DEPOSITION OF METAL ON CONDUCTIVE AND NONCONDUCTIVE SURFACES

(71) Applicant: Oceanit Laboratories, Inc., Honolulu, HI (US)

(72) Inventors: Ganesh K. Arumugam, Honolulu, HI (US); Matthew A. Nakatsuka, Honolulu, HI (US); Sumil S. Thapa, Honolulu, HI (US)

(73) Assignee: OCEANIT LABORATORIES, INC., Honolulu, HI (US)

( * ) Notice: Subject to any disclaimer, the term of this patent is extended or adjusted under 35 U.S.C. 154(b) by 0 days.

(21) Appl. No.: 15/655,247

(22) Filed: Jul. 20, 2017

Related U.S. Application Data

(60) Provisional application No. 62/364,529, filed on Jul. 20, 2016.

(51) Int. Cl.

| | |
|---|---|
| ***C23C 18/54*** | (2006.01) |
| ***C23C 18/16*** | (2006.01) |
| ***C23C 10/10*** | (2006.01) |
| ***C23C 10/18*** | (2006.01) |
| ***C11C 3/00*** | (2006.01) |
| *B63B 35/00* | (2020.01) |
| *B63G 8/00* | (2006.01) |

(52) U.S. Cl.
CPC ..... *C23C 10/10* (2013.01); *C11C 3/00* (2013.01); *C23C 10/18* (2013.01); *C23C 18/1655* (2013.01); *C23C 18/54* (2013.01); *B63B 35/00* (2013.01); *B63G 8/00* (2013.01)

(58) Field of Classification Search
CPC ..... C23C 10/10; C23C 10/18; C23C 18/163; C23C 18/1655; C23C 18/54; C11C 3/00; B36B 35/00; B63G 8/00; B63B 35/00
See application file for complete search history.

(56) References Cited

U.S. PATENT DOCUMENTS

| | | | | |
|---|---|---|---|---|
| 3,271,813 | A * | 9/1966 | Gernandt | A22C 17/006 249/114.1 |
| 4,289,631 | A * | 9/1981 | Luxemburg | C21B 7/12 106/1.23 |
| 4,772,344 | A * | 9/1988 | Andoe | B63B 59/04 156/212 |
| 4,935,110 | A | 6/1990 | Nishiki | |
| 5,051,324 | A | 9/1991 | Bones et al. | |
| 5,149,566 | A * | 9/1992 | Morton | C23C 18/1616 205/151 |
| 5,733,434 | A | 3/1998 | Harada | |
| 6,291,091 | B1 | 9/2001 | Preischl et al. | |

(Continued)

FOREIGN PATENT DOCUMENTS

| | | | | |
|---|---|---|---|---|
| JP | 05148681 | A | 6/1993 | |
| JP | 2002367634 | A | 12/2012 | |
| WO | WO-2014122726 | A1 * | 8/2014 | C23C 18/1617 |

*Primary Examiner* — Katherine A Bareford
(74) *Attorney, Agent, or Firm* — Cermak Nakajima & McGowan LLP; James Creighton Wray

(57) ABSTRACT

Electroless underwater metal plating of a surface of fixed or floating structure is accomplished by transferring to the surface metal ions from a metal precursor in a solid or semisolid electrolyte that is pressed against and moved over a submerged surface. Metal ions from a metal salt blended in the solid or semisolid material plate the underwater substrate.

19 Claims, 4 Drawing Sheets

During Application

(56) References Cited

U.S. PATENT DOCUMENTS

| | | | | |
|---|---|---|---|---|
| 2001/0040290 | A1* | 11/2001 | Sakurai | H01L 23/3128 257/737 |
| 2007/0045106 | A1 | 3/2007 | Yang | |
| 2007/0080055 | A1* | 4/2007 | Mance | B01J 23/755 204/192.1 |
| 2007/0171597 | A1 | 7/2007 | Merker | |
| 2012/0111719 | A1 | 5/2012 | Kendig | |
| 2012/0222967 | A1 | 9/2012 | Oakes | |
| 2014/0224662 | A1* | 8/2014 | Arumugam | C25D 5/06 205/93 |
| 2015/0345024 | A1* | 12/2015 | Kanazawa | C23C 18/1617 106/1.23 |
| 2016/0177463 | A1* | 6/2016 | Arumugam | C25D 5/22 205/93 |

* cited by examiner

During Application

SUBMERGED UNDERWATER ELECTROLESS, ELECTROCHEMICAL DEPOSITION OF METAL ON CONDUCTIVE AND NONCONDUCTIVE SURFACES

This application claims the benefit of U.S. Provisional Application No. 62/364,529 filed Jul. 20, 2016, which is hereby incorporated by reference in its entirety as if fully set forth herein.

This invention was made with Government support under Contract N00014-09-C-0177 awarded by the Office of Naval Research. The Government has certain rights in this invention.

FIELD OF THE INVENTION

The invention applies to electroplating, metal deposition, electroless plating, surface cleaning, surface coating, surface modification, surface preparation, selective metal coating, surface refurbishment, surface protection, corrosion and foul resistant coating.

BACKGROUND OF THE INVENTION

Conventional methods of electroplating or electroless plating use a liquid electrolyte with an anode and a cathode. The metal ion from the electrolyte is deposited on to the cathode when an electric potential is applied. Electroless plating immerses an object in a hazardous electroplating bath. Electroless deposition is used to deposit metal on conductive or nonconductive surfaces through an autocatalytic reaction through which metal is deposited without the application of electric potential. Another alternative electroplating process is called brush plating that uses a cloth covered brush plating wand that can be dipped in electroplating solution. A potential is applied between the wand and the depositing surface. Brush plating is similar to painting wherein a wand or cloth covered wand or brush wetted with electrolyte can be brushed on the surface to deposit metal.

There are several drawbacks on current state of the art electroplating, electroless plating and brush plating. One of the biggest drawbacks of electroplating, brush plating or electroless plating is the use of toxic and hazardous liquid electrolytes that makes the process difficult to be a portable technique.

The need for electrochemical potential to drive deposition reaction makes the deposition technique viable only on conductive metal surfaces and requires a power source to drive the deposition. The process is labor intensive. Liquid electrolyte does not allow repair of more intricate, damaged structures in hard to reach areas.

Traditional electroplating, brush plating or electroless plating have been used to coat metal on various metallic surfaces, but have several drawbacks in terms of portability, ease of application, toxicity and safety of electrolyte solution.

Currently metal deposition using electrochemical plating is limited to conductive surfaces. Other modes of metal deposition such as vapor, plasma or sputtering deposition are complicated, expensive and not suitable for large scale operations. Electroless metal deposition is an alternative technique but requires hazardous electrolyte and lacks the tools to perform on complex and intricate geometries, limiting the applications of the process.

Needs exist for improved deposition of metals on surfaces, especially surfaces subject to corrosion and unwanted adherence of biological or chemical matter.

SUMMARY OF THE INVENTION

This invention provides a novel submerged underwater electroless deposition method and novel metal-electrolyte assembly to selectively deposit metal on metal, polymer or ceramic surfaces with or without the aid of external stimuli, such as electric potential, heat or light, etc. to drive the metal ion deposition. The invention provides a novel underwater metal deposition method and system that can be used to selectively deposit metal in situ on various submerged fresh or saltwater surfaces without the use of external stimuli.

The invention includes a method for using a package of electrolytes used in electroplating, brush plating or electroless plating in a conformable solid or semisolid material. The solid or semisolid material is used underwater to deposit metals on a surface by brushing or rubbing the conformable solid over the underwater surface while the surface is submerged underwater. Ionic or nonionic electrolytes are provided in a moldable solid form. The moldable form facilitates the underwater electrochemical application on differently shaped substrates. The underwater deposition is completed without using any added liquid medium.

In specific examples, a new moldable copper based electrode-electrolyte assembly is used to deposit copper on a submerged steel or on a fiberglass surface. This novel underwater electrolyte process improves the ease of electroplating by minimizing or eliminating the need for using external power sources to trigger the electrochemical reaction while applying and attaching the coatings underwater.

The unique way of packaging and using the electrolyte eliminates the need for using a highly corrosive liquid electrolyte and eliminates the corrosive waste generated from the process. The new package can be used to perform electroless deposition on conductive and nonconductive surfaces. The novel process eliminates the needs for lifting craft out of water or raising and replacing anchored surfaces. An advantage of this unique approach to perform metal deposition is that the deposition can be performed without any toxic/hazardous electrolyte solution and offers complete mobility. The solid electrolyte is easily portable and requires no special equipment to perform underwater deposition on hard to reach areas and intricate structural components.

The new simple underwater method of depositing metal on conductive and nonconductive surfaces without the use of complex equipment is highly desirable for use in various industrial sectors.

The commercial value of the invention includes metal deposition on conductive and nonconductive surfaces without raising the surfaces from water by cranes or dry docks. The invention is usable in heavy machinery, defense, military, marine structures, offshore submerged objects, commercial and pleasure vessels and crafts, oil and gas industries and any other maintenance activities on underwater and water borne objects.

Major plating and finishing industries such as ship building and maintenance, oil and gas exploration and recovery, and companies that use expensive, complex, labor intensive preparation and metal deposition processes on surfaces that are submerged should be interested in the invention.

The new invention provides an underwater electroless metal deposition process with the use of solid electrolyte, provides an underwater electroless electrolytic process that improves the ease of deposition of metals on various conductive and nonconductive surfaces, eliminates needs for large quantities of electrolyte for electrodeposition, provides a completely mobile electrolyte system and offers an alternative and low cost solution for metal deposition in situ underwater without need for complicated tools and equipment.

The new and innovative method uses the electrolytes packaged into highly conformable tools to selectively deposit metal on various surfaces just by brushing or rubbing the tools on the surfaces with no need for an electrical power supply or liquid electrolyte. The novel underwater applications with the innovative packaging and tools offers significant advantages to perform underwater electroless metal deposition on any kinds of surfaces and geometries and suitable for a variety of applications where submerged in situ metal deposition is highly desired.

This invention provides unique and novel underwater electroless deposition using the novel electrode/electrolyte assemblies as well as solid or semisolid composite electrolyte materials. A simple, scalable synthetic route fabricates a highly moldable, solidified electrolyte for potential use in submerged underwater electrochemical applications especially electroplating, anodization, etching, etc. Surprisingly, the novel electrode/electrolyte assemblies can be used underwater for above mentioned electrochemical applications.

Oceanit has developed a revolutionary approach of packaging ionic and nonionic electrolytes in moldable solid form and revolutionary in situ submerged underwater applications. The electrochemical process is easily applicable on differently shaped underwater substrates which previously had not been the subject of underwater electrodeposition and electroless deposition. As a specific part, Oceanit pursued the development of electroplating solution tools packaged in a moldable form that improved the brush plating process by eliminating the need for electrolyte recirculation and used underwater. By packaging the electrolyte in a solid form, Oceanit has eliminated the need for liquid electrolytes to be used in the brush plating process. By using the tools underwater, Oceanit has eliminated the need for cranes and dry docks for electrodeposition on hulls and fixed structures. A conformable electrolyte can be molded in to any desired shape for hard to reach areas to fill large cracks and crevices and to provide a uniform and smooth surface finish on underwater surfaces.

A moldable electrode/electrolyte containing the required metal ion and the ability to perform plating is used on submerged surfaces. The approach of making moldable electrode/electrolyte also significantly improves the ability to perform plating and surface finishes operation even on regions such as submerged surfaces unplatable using the traditional brush plating or any metal deposition process.

A solid electrolyte having precursor, binder and medium in solid or semisolid form provides tools having the product combined in an electrode/electrolyte assembly for electrochemical treatment of previously untreatable substrates in situ underwater. The solid electrolyte includes metal salts, nanoparticles, organometallic precursor, polymer or ionic organic compounds. The binder includes polymers, polyethylene oxide, polyacrylic acid, polyvinyl alcohol, polyvinyl pyrrolidone, silicones, inorganic binders, silicate, surfactants or cetyltrimethyl ammonium bromide. The medium includes aqueous (acidic and basic) or non-aqueous solvent, ionic liquid or aprotic solvent.

The solid electrolyte is a moldable or conformable solid or semisolid in moldable form for the new underwater use. The solid electrolyte material is an electrolyte capable of performing electroplating, polishing, winning, etching or anodizing electrochemical and electroless plating. Its underwater use opens many avenues of protection heretofore not available to existing anchored structures or vessels. An ionic or nonionic electrolyte is in a moldable solid or semisolid form. The ionic or nonionic electrolyte is a mixture of precursor, binder and medium. The solid electrolyte is formed with a mixture of electrochemical material and binder. The solid electrolyte is provided with a handle on the electrode. Holding the solid electrolyte with the handle and moving the solid electrolyte in contact with the submerged surface of the substrate completes the underwater process.

Holding the solid electrolyte with or without the handle and moving the solid electrolyte in contact with the surface of the underwater substrate and transferring precursor from the solid electrolyte to the surface of the submerged substrate performs the deposition process. The disparate base and coating metals may create autonomous bimetallic (galvanic) currents that plate the coating metal on the underwater base metal. When the base is a nonconductive material, a thin conductive layer or charge on the surface can be applied before metal deposition.

The precursor is a metal salt, copper chloride, copper sulfate chromium chloride, chromium sulfate, nickel sulfate, nickel formate, nickel acetate, nickel chloride, zinc sulfate, organic compounds, pyridine, pyrrole, aniline, organometallic compounds, trimethylgallium, trimethylindium or trimethylaluminum, as examples. The solid electrolyte precursor and the precursors are transferred from the solid electrolyte to a submerged surface of the substrate by using the handle to move the solid electrolyte over the surface of the underwater substrate.

Mixing the electrochemical material and polymer binder with or without fatty acid surfactant in a blender with or without solvent medium, pouring the blended mixture in a mold and drying the mixture forms the solid or semisolid electrolyte form for attachment to the electrode.

Mixing the electrochemical material and polymer binder with or without fatty acid surfactant in a blender with or without solvent medium, pouring the blended mixture in a mold for chemical or physical crosslinking the mixture, thereby forms the solid or semisolid electrolyte pad.

Mixing the electrochemical material and polymer binder with or without fatty acid surfactant in a blender with or without solvent medium, pouring the blended mixture in a mold having an electrode and drying the mixture or chemical or physical crosslinking thereby forms the solid or semisolid electrolyte/electrode assembly, readying the assembly for use underwater to treat submerged surfaces of structures or vessels.

The new method includes underwater deposition of a metal on an underwater substrate.

Blending a metal precursor and a binder and molding the blended metal precursor and the binder forms a block of the blended metal precursor and the binder having a desired shape.

Pressing the block underwater against the underwater substrate and moving the block underwater on the underwater substrate transfers metal ions underwater from the metal precursor to the substrate and coats the underwater substrate with the metal.

The blending further includes blending a fatty acid surfactant with the metal precursor and the binder before the molding. The blending further includes blending a solvent with the metal precursor and the binder before the molding.

When the substrate is a non-conductive substrate, a charge is placed on the non-conductive substrate before pressing and moving the block underwater on the non-conductive substrate. When the substrate is a non-conductive substrate, a thin conductive layer may be provided on the underwater substrate before pressing and moving the block underwater on the non-conductive substrate.

When the substrate is metal and the metal coatings are disparate, autonomous bimetallic (galvanic) currents are created between the underwater metal substrate and the transferring metal.

When the underwater substrate is a fixture or a floating hull, the metal deposition on the underwater substrate is selected from the group consisting of electroless plating, surface cleaning, surface modification, surface preparation, selective metal coating, surface refurbishment, surface protection, corrosion and foul resistant coating.

The precursor includes metal ions and metal salt. The binder is a polymer. A handle is extended from the solid or semisolid molded block.

These and further and other objects and features of the invention are apparent in the disclosure, which includes the above and ongoing written specification, with the claims and the drawings.

DETAILED DESCRIPTION

Figure 1:
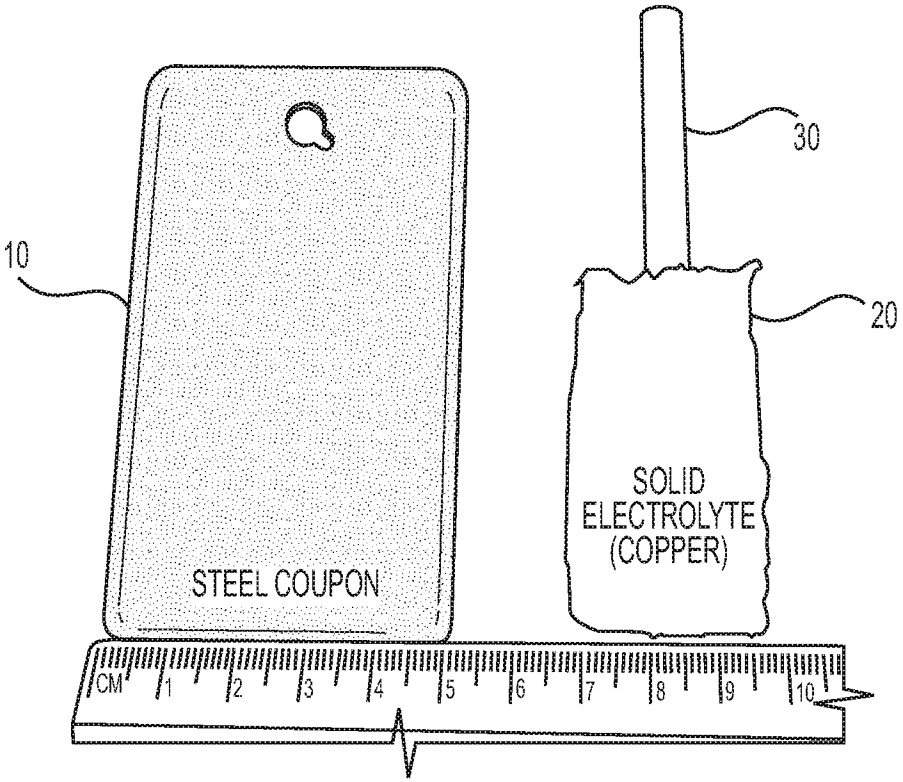
FIG. 1 is a photograph of a steel coupon and a new solid electrolyte prior to underwater application of the copper coating on the steel coupon.

FIG. 1 is a photograph of a steel coupon 10 and a new solid electrolyte 20 prior to underwater application of a copper coating on the steel coupon. One example of the invention shows a steel coupon 10 and a new solid electrolyte block 20 for coating the steel coupon 10 with copper from the solid electrolyte block 20. Block 20 is shown to be round or oval. Any shape may be used. Handle 30 extends from the solid electrolyte block 20 for holding and controlling the electrolyte block 20 as it is brushed or rubbed on the surface 12 of the steel coupon 10

Figure 2:
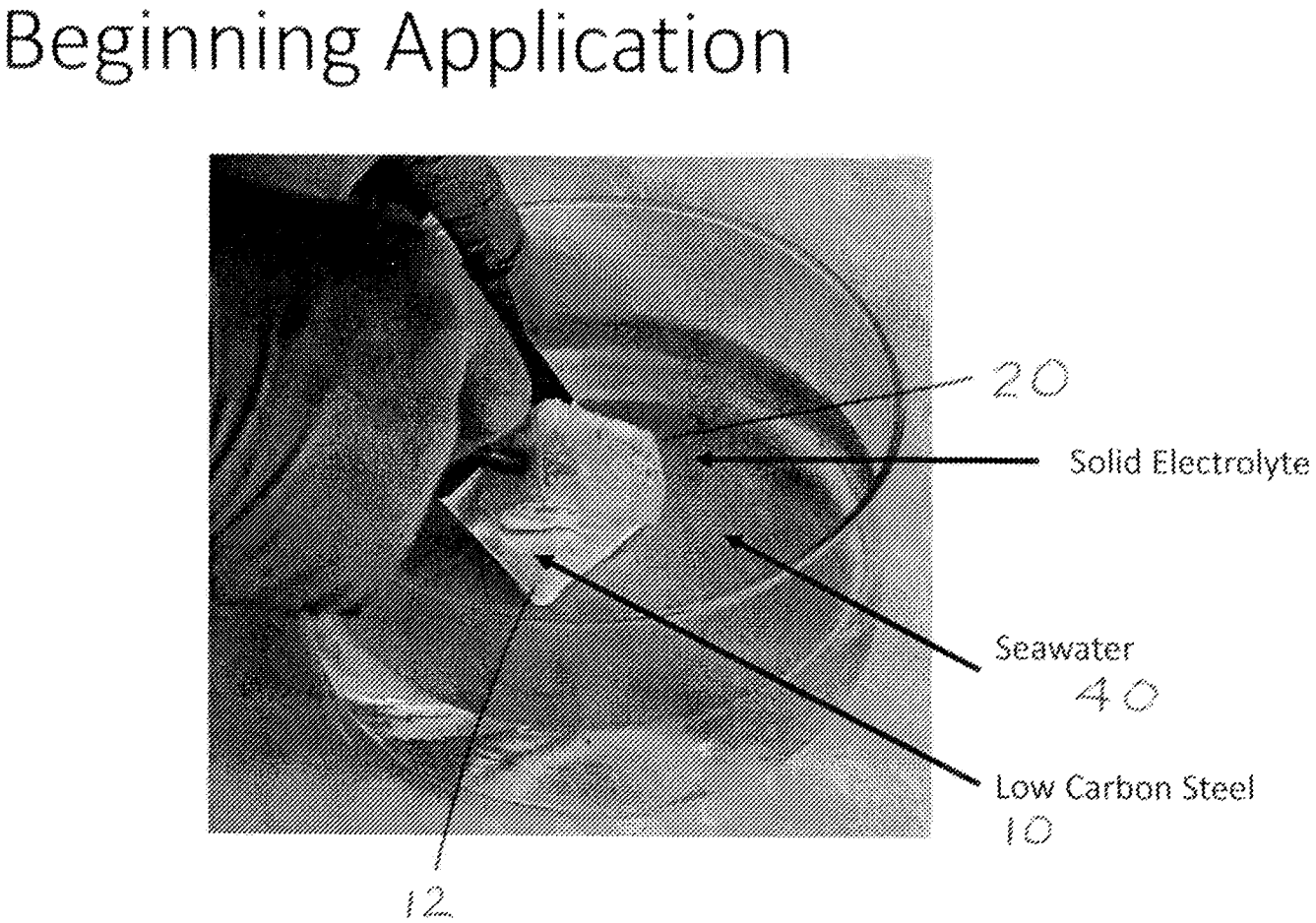
FIG. 2 is a photograph of solid electrolyte before application on the underwater surface of the steel coupon.

FIG. 2 is a photograph of solid electrolyte 20 before application on the underwater surface 12 of the steel coupon 10. The steel coupon 10 and electrolyte block 20 are submerged in seawater 40. Solid electrolyte block 20 is shown before being rubbed on to the submerged underwater surface 12 of the low carbon steel coupon 10.

Figure 3:
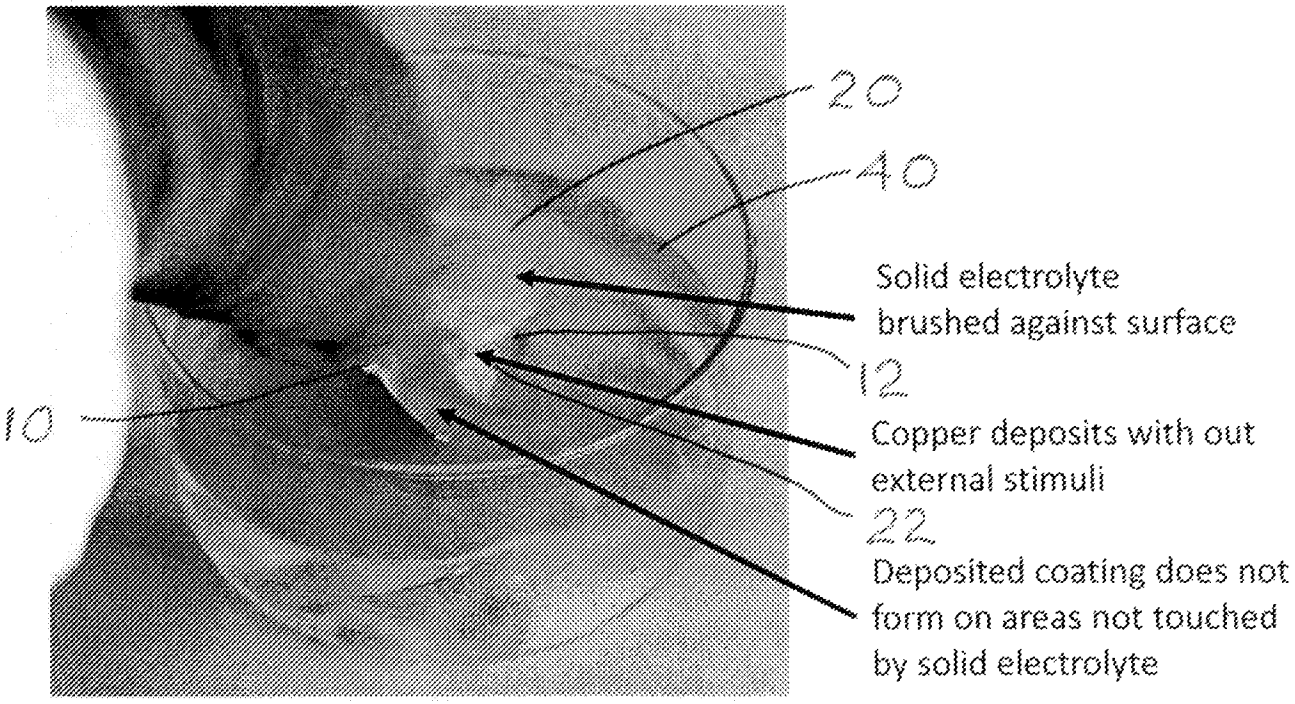
FIG. 3 is a photograph of submerged solid electrolyte being brushed against the underwater surface of the steel coupon, resulting in copper coating.

FIG. 3 is a photograph of solid electrolyte block 20 being rubbed or brushed on to the submerged underwater surface 12 of the steel coupon 10, resulting in copper deposition. A copper coating 22 is deposited on the surface 12 of the coupon 20, producing a copper coated surface on the coupon 10.

Figure 4:
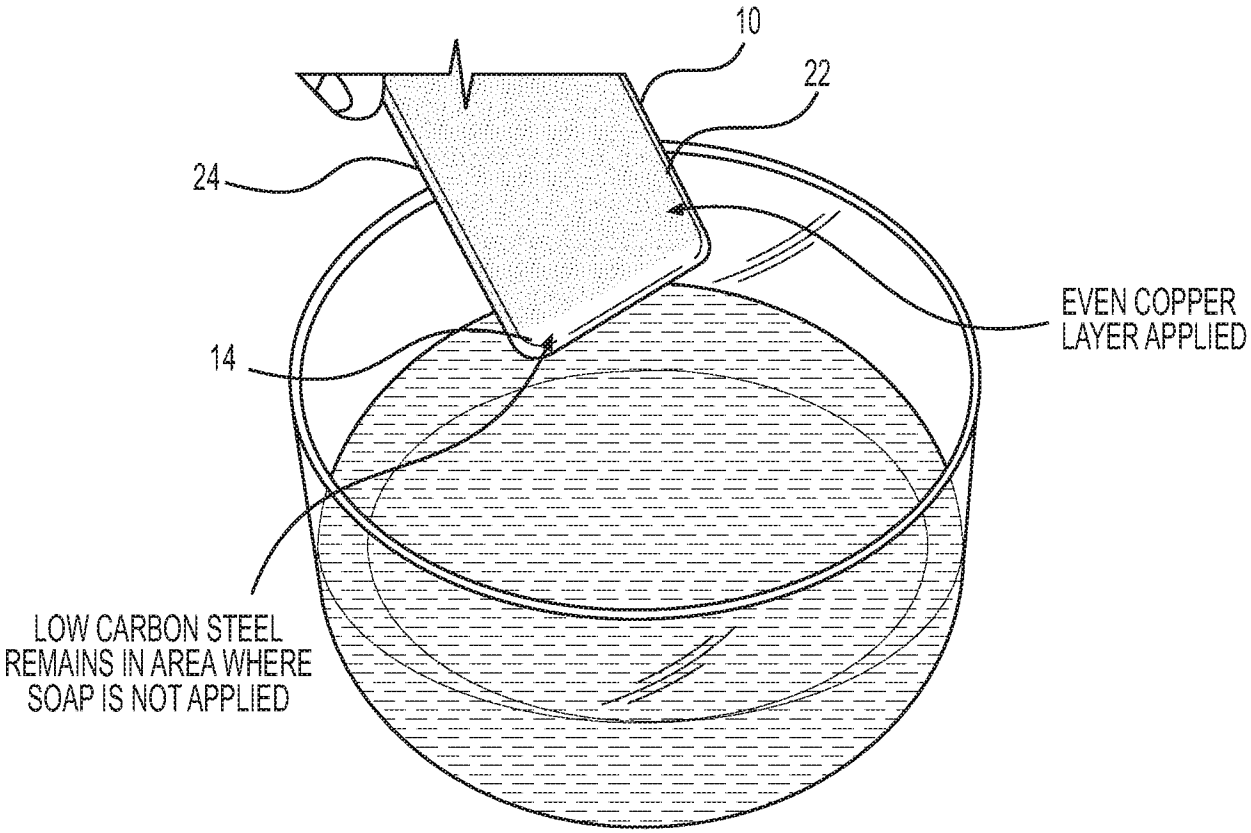
FIG. 4 is a photograph of the steel coupon being lifted and showing the copper deposited underwater on the steel coupon using the solid electrolyte.

FIG. 4 is a photograph the steel coupon 10 being lifted and showing the copper 22 deposited underwater on the steel coupon from the solid electrolyte. A copper coating 22 has been deposited on the steel coupon underwater using solid electrolyte. A copper coating 22 has been deposited on the surface of the coupon 20 which has been touched by the electrolyte block, producing a copper coated surface 24 on the coupon 10. The low carbon steel remains exposed in the part 14 of the surface which had not been brushed by the solid electrolyte block 20.

A handle 30 or a handle with a rigid or flexible blade or other shaped body is embedded in the block 20 when the block is molded. In one form, fine copper precursor solution is embedded in a polymer binder, which is molded in a rigid mold or softened and formed into a desired shape, forming a block. The block is pressed and moved along a submerged underwater surface plating the surface with the copper. The electrolyte block could be composed of water soluble salts of transition metals such as copper, iron, nickel, chromium, gold, platinum, silver, etc. dispersed in a polymer solution such as polyethylene oxide, poly acrylic acid, polyvinyl alcohol, polyvinyl pyrrolidone, polyvinyl acetate, etc.

Examples of the metal salts that could be used to make electrolyte blocks could be copper sulfate, nickel sulfate, nickel acetate, chromium trioxide, silver nitrate, hydrogen tetrachloroaurate, gold cyanide, platinum chloride, etc. The metal salt content in the electrolyte block could be from 0 to 95 weight % and remaining could be the polymer solution acting as a binder to hold the salt solution.

Depending upon the electrolyte salt and content, the polymer content could also be varied from 0 to 75 weight % dispersed in water or alkaline medium (potassium hydroxide, sodium hydroxide) or in acidic medium (sulfuric acid, nitric acid, chromic acid, hydrochloric acid, etc.) and could contain additional ion conducting materials 0 to 25 weight % such as ionic liquids, e.g. 1-butyl-3-methylimidazolium chloride (BMIMC1) or ionic salts such as sodium chloride, potassium chloride, sodium sulfate as supporting electrolytes.

Depending upon the nature of the metal, the electrolyte block would show a fading in color, suggesting the depletion of metal ions in the electrolyte block.

The method of manufacturing these electrolyte blocks could be performed using standard polymer mixing and extrusion processes or can be blended and heated together in large polymer mixers and cast into blocks or poured into molds of any desired size and shape.

This invention provides using the electrode electrolyte assemblies as well as solid or semisolid composite electrolyte materials for standard electrochemical operations on submerged underwater structures or vessels for electroplating, electropolishing, electrowinning, electrochemical etching or anodization. A simple, scalable synthetic route fabricates and uses the highly moldable, solidified electrolyte for potential use in underwater electrochemical applications, especially electroplating of submerged underwater structures and vessels, anodization, etching, etc. The novel electrode/electrolyte assemblies are used in novel underwater surface applications for the above-mentioned electrochemical procedures.

Oceanit has developed revolutionary underwater treatment of submerged surfaces of the new ionic and nonionic electrolytes in moldable solid form, making the electrochemical process easily applicable on differently shaped underwater substrates.

The conformable electrolyte is molded in to any desired shape for hard to reach areas to fill large cracks and crevices and to provide a uniform and smooth underwater surface finish.

Oceanit's invention uses a moldable electrode/electrolyte containing the required metal ion and the ability to perform plating underwater. The underwater approach of using the moldable electrode/electrolyte also significantly improves the ability to perform plating and surface finishes operation on previously unplatable underwater surfaces.

The invention uses a new solid electrolyte having precursor, binder and medium in solid or semisolid form as a tool having the product combined in an electrode/electrolyte assembly for electrochemical treatment of submerged underwater substrates. The solid electrolyte includes metal salts, nanoparticles, organometallic precursor, polymer or ionic organic compounds. The binder includes polymers polyethylene oxide, polyacrylic acid, polyvinyl alcohol, polyvinyl pyrrolidone, silicones, inorganic binders, silicate, surfactants or cetyltrimethyl ammonium bromide. The medium includes aqueous or non-aqueous solvent, ionic liquid or aprotic solvent. The solid electrolyte is a moldable or conformable solid or semisolid in moldable form.

The solid electrolyte material is an electroplating, polishing, winning, etching or anodizing electrochemical, and the underwater chemical treatment includes plating, polishing, winning, chemical etching or anodization and electroless plating.

The invention treats submerged underwater surfaces with a solid electrolyte block having a metal salt mixed with polymer solution as a binder solidified around a handle and formed as a solid electrolyte block with the mixed metal salt and the binder by pressing and moving the solid electrolyte block along a surface submerged underwater and plating the surfaces with a metal from the metal salt from the solid electrolyte. While the invention has been described with reference to specific embodiments, modifications and variations of the invention may be constructed without departing from the scope of the invention, which is defined in the following claims.

We claim:

1. A method comprising:

underwater deposition of a metal on an underwater metal substrate in an underwater environment, further comprising:

blending a metal precursor and a binder, molding the blended metal precursor and the binder, forming a block of the blended metal precursor and the binder having a desired shape, extending a handle from the molded block, pressing the block underwater against the underwater substrate in presence of fresh or saltwater in the underwater environment, moving the block underwater on the underwater substrate, transferring metal ions underwater from the metal precursor to the substrate, and plating the underwater substrate with the metal from the blended metal precursor without using an electrical power supply to trigger an electrochemical reaction while applying and attaching coatings underwater.

2. The method of claim 1, wherein the blending further comprises blending a fatty acid surfactant with the metal precursor and the binder before the molding.

3. The method of claim 1, wherein the blending further comprises blending a solvent with the metal precursor and the binder before the molding.

4. The method of claim 1, wherein the substrate is a non-conductive substrate, and further comprising placing a charge on the non-conductive substrate before pressing and moving the block underwater on the non-conductive substrate.

5. The method of claim 1, wherein the substrate is a non-conductive substrate, and further comprising providing a thin conductive layer on the underwater substrate before pressing and moving the block underwater on the non-conductive substrate.

6. The method of claim 1, wherein the underwater substrate is a fixture and further comprises the metal deposition on the underwater substrate is selected from the group consisting of surface modification, selective metal coating, surface refurbishment, surface protection, corrosion and foul resistant coating.

7. The method of claim 1, wherein the underwater substrate is a floating hull and the underwater metal deposition is selected from the group consisting of electroless plating, surface modification, surface preparation, selective metal coating, surface refurbishment, surface protection, corrosion and foul resistant coating on the floating hull.

8. The method of claim 1, wherein the precursor includes metal ions.

9. The method of claim 1, wherein the precursor is a metal salt.

10. The method of claim 1, wherein the binder is a polymer.

11. The method of claim 1, wherein blending a metal precursor and a binder further comprises blending with a medium which is a solvent.

12. The method of claim 1, wherein the precursor is a metal salt selected from the group consisting of copper chloride, copper sulfate chromium chloride, chromium sulfate, nickel sulfate, nickel acetate, nickel chloride, nickel formate, zinc sulfate, organic compounds, pyridine, pyrrole, aniline, organometallic compounds, trimethylgallium, trimethylindium and trimethylaluminum.

13. The method of claim 1, wherein the substrate is a metal, a polymer or a ceramic surface.

14. The method of claim 1, wherein the binder is selecting from the group consisting of polymers, polyethylene oxide, polyacrylic acid, polyvinyl alcohol, polyvinyl pyrrolidone, silicones, inorganic binders, silicate, surfactants and cetyltrimethyl ammonium bromide.

15. The method of claim 1, further comprising:

wherein the molded block is an underwater electroless metal deposition block, and the plating is electroless plating, further comprising:

a solid electrolyte having metal salts, nanoparticles, organometallic precursor, polymer or ionic organic compounds with the binder having polymers, polyethylene oxide, polyacrylic acid, polyvinyl alcohol, polyvinyl pyrrolidone, silicones, inorganic binders, silicate, surfactants or cetyltrimethyl ammonium bromide.

16. The method of claim 1, wherein blending a metal precursor and a binder further comprising blending with an ionic liquid or aprotic solvent.

17. The method of claim 1, wherein the molded block is a solid or semisolid molded block.

18. The method of claim 1, wherein the substrate is metal, and the metal plating further comprises creating autonomous bimetallic currents between the underwater metal substrate and the transferring metal.

19. A method comprising:

electroless plating a substrate with a metal underwater in an underwater environment by:

blending a metal precursor and a polymer binder, molding the blended metal precursor and polymer binder into a block of solid or semisolid electrolyte predetermined shape, extending a handle from the molded block;

pressing the block against an underwater substrate in presence of fresh or saltwater in the underwater environment, moving the block along the substrate, transferring the solid or semisolid electrolyte to the underwater substrate, and plating the underwater substrate with metal from the blended metal precursor with no electrical power supply.

* * * * *